US007004238B2

(12) United States Patent
Seyed-Yagoobi et al.

(10) Patent No.: US 7,004,238 B2
(45) Date of Patent: Feb. 28, 2006

(54) ELECTRODE DESIGN FOR ELECTROHYDRODYNAMIC INDUCTION PUMPING THERMAL ENERGY TRANSFER SYSTEM

(75) Inventors: Jamal Seyed-Yagoobi, College Station, TX (US); Karine Brand, Bryan, TX (US)

(73) Assignee: Illinois Institute of Technology, Chicago, IL (US)

( * ) Notice: Subject to any disclaimer, the term of this patent is extended or adjusted under 35 U.S.C. 154(b) by 25 days.

(21) Appl. No.: 10/023,512

(22) Filed: Dec. 18, 2001

(65) Prior Publication Data

US 2003/0111214 A1 Jun. 19, 2003

(51) Int. Cl.
*F28F 13/12* (2006.01)

(52) U.S. Cl. ..... 165/96; 165/109.1; 417/48

(58) Field of Classification Search ..... 165/96, 165/109.1; 417/48
See application file for complete search history.

(56) References Cited

U.S. PATENT DOCUMENTS

| | | | | | |
|---|---|---|---|---|---|
| 2,605,377 | A | * | 7/1952 | Kaehni et al. | 165/109.1 |
| 3,440,458 | A | * | 4/1969 | Knight | 310/11 |
| 3,778,678 | A | * | 12/1973 | Masuda | 417/48 |
| 3,872,361 | A | * | 3/1975 | Masuda | 361/233 |
| 3,970,905 | A | * | 7/1976 | Itoh et al. | 361/233 |
| 4,168,743 | A | * | 9/1979 | Arai et al. | 165/905 |
| 4,316,233 | A | | 2/1982 | Chato et al. | |
| 4,484,624 | A | * | 11/1984 | Vleggaar et al. | 165/905 |
| 4,612,982 | A | * | 9/1986 | Grehier et al. | 165/172 |
| 4,651,806 | A | | 3/1987 | Allen et al. | |
| 4,871,017 | A | * | 10/1989 | Cesaroni | 165/170 |
| 5,072,780 | A | | 12/1991 | Yabe | |
| 5,769,155 | A | * | 6/1998 | Ohadi et al. | 165/96 |
| 6,059,950 | A | * | 5/2000 | Dames et al. | 204/547 |
| 6,374,909 | B1 | * | 4/2002 | Jeter et al. | 165/96 |

FOREIGN PATENT DOCUMENTS

| | | | | |
|---|---|---|---|---|
| JP | 62041594 A | * | 2/1987 | 165/96 |
| JP | 01046590 A | * | 2/1989 | 165/96 |
| WO | WO 00/71957 | | 11/2000 | |

OTHER PUBLICATIONS

Patent Abstracts of Japn, JP-59134495, dated Feb. 8, 1984.
An Experimental Study of Electrohydrodynamic Induction Pumping of a Stratified Liquid/Vapor Medium, by M. Wawzyniak, J. Seyed-Yagoobi & G.L. Moorison, Proceedings of the 5th ASME/JSME : Thermal Engineering Joint Conference, pp. 1-9, Mar. 15-19, 1999.
An Analytical Study of Electrohydrodynamic Induction Pumping of a Stratified Liquid/Vapor Medium, by M. Wawzyniak and J. Seyed-Yagoobi, IEEE Transactions on Industry Applications, vol. 35, No. 1, pp. 231-239, Jan./Feb. 1999.

(Continued)

*Primary Examiner*—Leonard R. Leo
(74) *Attorney, Agent, or Firm*—Flynn, Thiel, Boutell & Tanis, P.C.

(57) ABSTRACT

An electrode configuration for use in association with a heat transfer member provided in a thermal energy transfer system. Separate multiple electrical conductors are each received on a respective first surface alteration. Each of the multiple conductors is connected to a different terminal of a multiphase alternating power source so that an electric traveling wave moves in a longitudinal direction of the heat transfer member so as to induce pumping of at least the liquid phase in the longitudinal direction to thereby enhance the thermal energy transfer characteristics of the thermal energy transfer system. In a preferred embodiment, the aforementioned heat transfer members are provided inside of an outer conduit.

10 Claims, 5 Drawing Sheets

OTHER PUBLICATIONS

An Analytical Study of Electrohydrodynamic Induction Pumping of a Stratified Liquid/Vapor Medium, M. Wawzyniak and J. Seyed-Yagoobi, Proceedings of Institute of Electrical and Electronics Engineers—Industry Applications Society, pp. 1879-1886, Oct. 5-9, 1997.

Electrohydrodynamic Induction Pumping of a Stratified Liquid/Vapor Medium in the Presence of Volumetric and Interface Electric Charges, by M. Wawzyniak and J. Seyed-Yagoobi, Proceedings of IEEE-IAS Meeting, pp. 1-10, Oct. 1999.

Recent Developments in EHD Enhanced Heat Transfer, by P.H.G. Allen and T.G. Karayiannis, Renewable Energy, vol. 5, Part I, pp. 436-445, 1994.

Effect of Electrode Position on Electrohydrodynamic Induction Pumping of a Stratified Liquid/Vapor Medium, by K. Brand and J. Seyed-Yagoobi, Submitted for IEEE-IAS Conference, pp. 1-8, Oct. 2000.

* cited by examiner

ELECTRODE DESIGN FOR ELECTROHYDRODYNAMIC INDUCTION PUMPING THERMAL ENERGY TRANSFER SYSTEM

FIELD OF THE INVENTION

This invention relates in general to the field of thermal energy transfer and, more particularly, to an electrohydrodynamic induction pumping thermal energy transfer system. Even more specifically, the invention relates to an electrode configuration for electrohydrodynamic induction pumping of a liquid in a thermal energy transfer system.

BACKGROUND OF THE INVENTION

The promotion of energy conservation and global environmental protection is establishing increased standards for more efficient production and utilization of energy in various industrial and commercial sectors. For example, the introduction of Ozone-safe refrigerants presents new challenges. Not only are the new refrigerants considerably more expensive, but the new refrigerants also generally exhibit poor thermal energy transfer characteristics. Additionally, thermal energy transfer devices, such as heat exchangers, condensers, and evaporators, are generally used to effectively utilize heat energy in a variety of applications. For example, condensers and evaporators may be utilized in electronic cooling systems, refrigeration systems, air conditioning systems, solar energy systems, geothermal energy systems and heating and cooling systems in the petrochemical field, the power generation field, the aerospace field, and microgravity environment.

One type of thermal energy transfer device may include an outer tube or conduit enclosing a tube bundle or group of smaller diameter inner conduits. In operation, thermal energy transfer occurs between a fluid disposed within the outer conduit and surrounding the inner conduits and a fluid contained within the inner conduits. In the case of a condenser, the fluid entering the outer conduit may be in a vapor phase which is to be condensed into a liquid phase. The condensation into the liquid phase is generally achieved by providing the fluid within the inner conduits at a temperature below a condensing temperature of the vapor.

Present thermal energy transfer devices, however, suffer several disadvantages. For example, in the case of the condenser described above, as the vapor condenses onto the inner conduits, the liquid condensing on the inner conduits disposed near an upper portion of the condenser falls or drips onto inner conduits disposed in a lower portion of the condenser, thereby decreasing the efficiency of thermal energy transfer of the lower inner conduits. Additionally, liquid condensing on the inner conduits prevents additional vapor from being exposed to the inner conduits, thereby also decreasing the efficiency of thermal energy transfer between the outer fluid and the fluid contained within the inner conduits.

WO 00/71957, the disclosure of which is incorporated herein by reference, presents a solution to the aforementioned problem. However, this reference shows that wires are in the pathway of the liquid that is to be pumped and, therefore, impedes the flow of liquid. Therefore, it is desirable to provide a structure which will achieve the benefits described in the aforementioned document, but provide for an unobstructed movement of liquid on the heat transfer member.

SUMMARY OF THE INVENTION

The objects and purposes of the invention are met by providing an electrode configuration for use in association with a heat transfer member provided in a thermal energy transfer system, which heat transfer member has separate first and second surfaces each subjected to separate first and second temperatures, at least one of the first and second surfaces also being configured to be subjected to a fluid so that a liquid phase of the fluid is present on the at least one of the first and second surfaces. The heat transfer member additionally has on the first surface multiple and separate first surface alterations extending coextensively with an axial length of the heat transfer member. Separate multiple electrical conductors are provided, each being received on a respective one of the separate first surface alterations. An electric multiphase alternating power source having multiple terminals and producing a number of phases corresponding to a number of the multiple terminals is provided, each of the multiple conductors being connected to a different one of the multiple terminals so that an electric traveling wave moves in a direction perpendicular to a longitudinal axis of the electrical conductors so as to induce pumping of at least the liquid phase in the direction to thereby enhance the thermal energy transfer characteristics of the thermal energy transfer system. In a preferred embodiment, the aforementioned heat transfer members are provided inside of an outer conduit.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
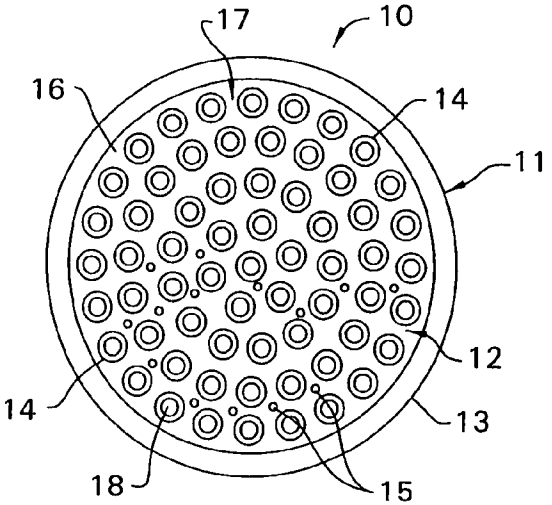
FIG. 1 is a diagram illustrating an electrohydrodynamic induction pumping thermal energy transfer system in accordance with an embodiment of the present invention.

FIG. 1 illustrates an electrohydrodynamic induction pumping thermal energy transfer system 10 comprising a thermal energy transfer device 11 for transferring thermal energy generally between fluids. The thermal energy transfer device 11 may comprise a condenser, evaporator, heat exchanger or other suitable thermal energy transfer device for transferring thermal energy between the fluids.

In the embodiment illustrated in FIG. 1, the thermal energy transfer device 11 comprises an inner conduit assembly 12 disposed within an outer tube or conduit 13. The inner conduit assembly 12 comprises a tube bundle or a collection and/or array of individual conduits or members 14. The individual conduits or members 14 may comprise a generally circular configuration; however, other suitable geometric configurations may be used for the conduits 14. Generally, the thermal energy transfer device 11 provides thermal energy transfer between a fluid 16 disposed within an interior region 17 of the outer conduit 13 surrounding the conduits 14 and a fluid 18 disposed within the individual conduits 14. For example, fluids 16 and 18 may be traveling in opposite directions within the thermal energy transfer device 11, and a fluid 18 may be at an elevated or reduced temperature relative to a temperature of the fluid 16 to cause thermal energy transfer through surfaces of the conduits 14. Instead of providing one of the fluids at an elevated temperature, a heating tape or solid state heating or cooling devices may be employed instead of providing a fluid.

Figure 2:
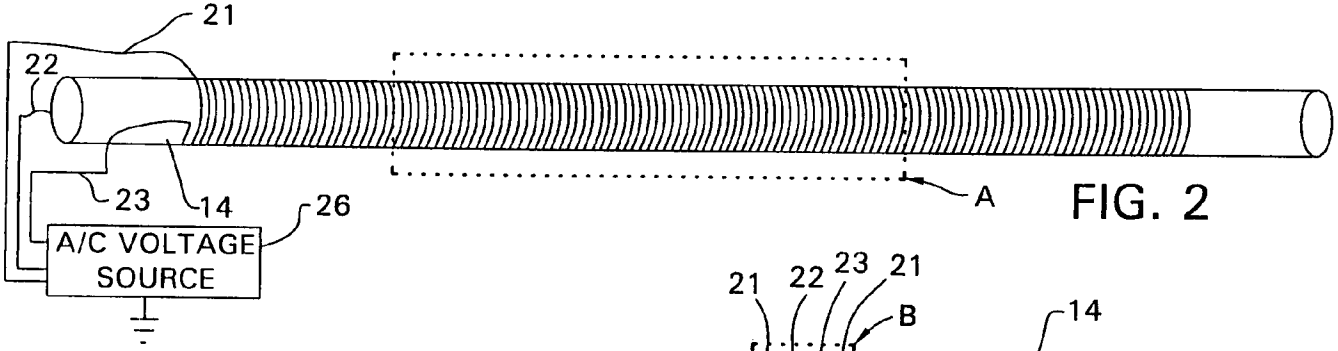
FIG. 2 is an enlarged isometric view of a heat transfer member on which is provided an electrode configuration embodying the invention.
Figure 3:
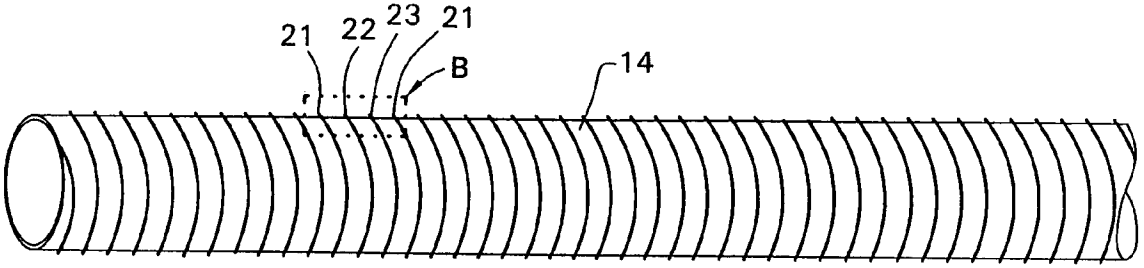
FIG. 3 is an enlargement of the section marked A in FIG. 2.
Figure 4:
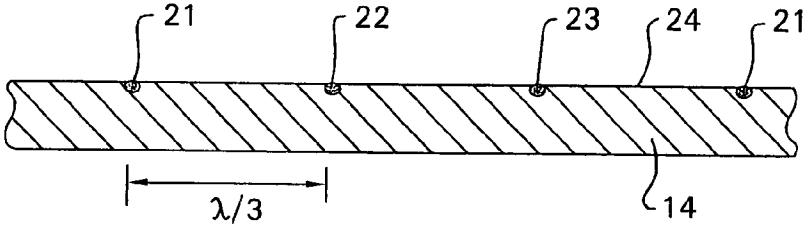
FIG. 4 is an enlargement of the section marked B illustrated in FIG. 3.

FIG. 2 illustrates an enlarged view of a single conduit 14 of the thermal energy transfer system 10. In this embodiment, plural and separate electrical conductors 21, 22 and 23 with exterior insulation 19 (FIGS. 9A and 9B) are disposed on an exterior surface 24 of the conduit 14 and extend longitudinally along the conduit 14. The individual conductors 21, 22 and 23 are disposed in a spaced apart relationship to each other and are each coupled to a phase alternating power supply 26 known from the above-referenced WO 00/71957. The power supply 26 may be configured to generate a variety of voltage waveforms at various voltages levels and frequencies. For example, the power supply 26 may be configured to generate sine, square, and/or triangle voltage waveforms at voltage levels between 0–15 kV (0 to peak) at various fluid-dependent frequencies. However, the power supply 26 may be otherwise configured to generate various voltage waveforms at other suitable voltages and frequencies. The aforementioned spacing between the consecutive electrical conductors is the wave length ($\lambda$) divided by the number of different phases (n). In the embodiment illustrated in FIGS. 2–4, three (n=3) separate electrical conductors have been provided and the power supply 26 is configured to generate three phase power, each 120° apart. Thus, the spacing between the individual conductors 21, 22 and 23 is $\lambda/3$ as illustrated in FIG. 4. Generally, the spacing between the electrodes is in the range of 0.01 mm and 30 mm.

Prior to orienting the electrodes 21, 22 and 23 on the surface 24 of the individual heat transfer members 14, the surface 24 is altered to provide a specific mounting location for the electrodes. In this particular embodiment, the surface 24 is altered to provide a groove 27 (FIGS. 5A–5J) in various patterns along the length of the heat transfer member 14. After the grooves 27 have been formed in the surface 24 of the heat transfer member 14, the selected electrode 21, 22 or 23 can be inserted into the groove 27 so that the body of the selected electrode is either flush with or oriented entirely beneath the surface 24 as illustrated in FIGS. 5A through 5J.

Figure 5A:
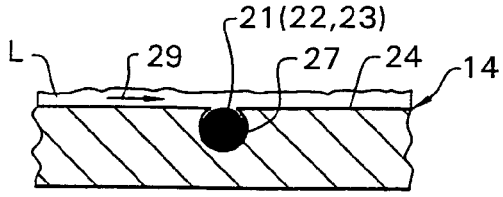
FIGS. 5A through 5J show various alternate embodiments of the electrode configuration embodying the invention.
Figure 5B:
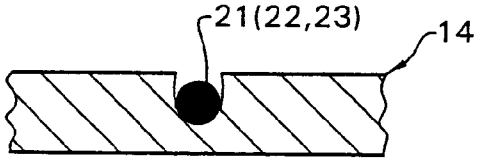
Figure 5C:
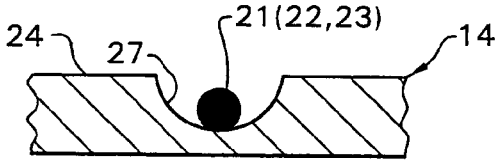
Figure 5D:
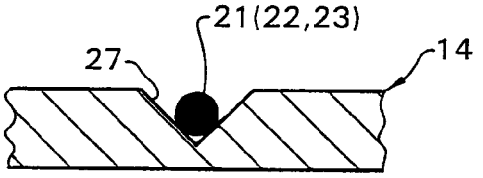
Figure 5E:
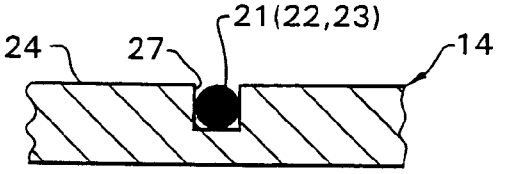
Figure 5F:
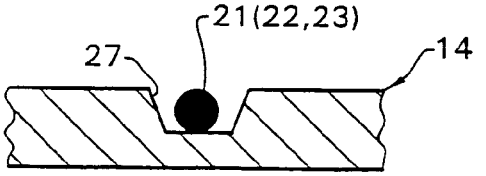
Figure 5G:
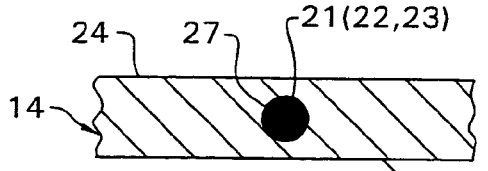
Figure 5H:
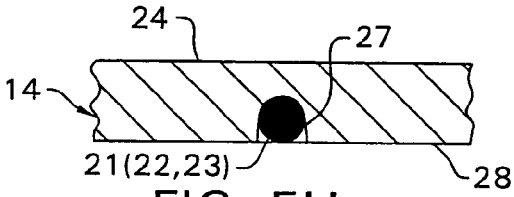
Figure 5I:
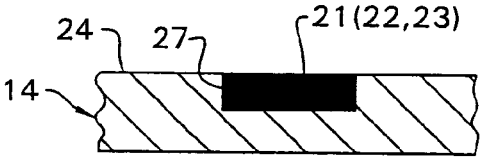
Figure 5J:
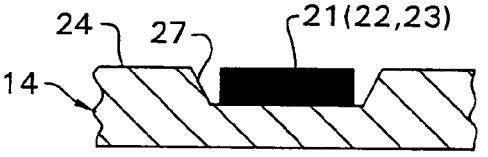

As illustrated in FIGS. 5A through 5J, the shape of the groove 27 is variable as is the cross-sectional shape of the electrical conductor. In other words, the electrical conductor 21, 22, 23 and the groove 27 can have a circular cross section as illustrated in FIGS. 5A through 5H or rectangular cross section as illustrated in FIGS. 5I through 5J. In addition, the groove 27 can be oriented on the exterior surface 24 or on the interior surface 28 as illustrated in FIG. 5H. In FIG. 5G, the electrode is oriented between the external surface 24 and the internal surface 28. This configuration would likely be achievable by working the material of the heat transfer member (usually copper or other suitable heat transferring material) on a selected surface thereof so as to provide a trench into which the electrode could be placed and the material of the heat transfer member worked so as to provide a smooth external surface 24 or internal surface 28. The important thing in FIGS. 5A–5J to note is that the selected electrode 21, 22 or 23 is oriented beneath the surface of the heat transfer member 14 so as to allow for the unobstructed flow of liquid L in either direction along the surface of the heat transfer member 14 as, for example, indicated by the arrow 29 in FIG. 5A.

Figure 6A:
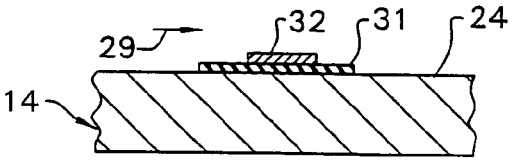
FIGS. 6A through 6B show a still further alternate construction of the electrode configuration embodying the invention.
Figure 6B:
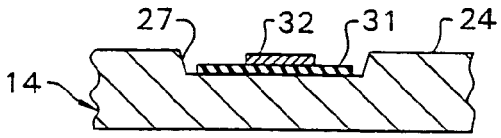

In some instances, it may be desirable to mount the wire to the external surface 24 of the heat transfer member 14. However, as noted above with respect to the electrodes disclosed in WO 00/71957, the wires will obstruct the flow of liquid along the longitudinal length of the heat transfer member. The surface 24 of the heat transfer member 14 can, as illustrated in FIG. 6A, be altered by providing a thin layer 31 of insulating material directly to the surface 24 and a thin layer 32 of electrically conductive material to formulate a selected one of the electrodes 21, 22 or 23. The thickness of the two layers 31 and 32 have been exaggerated in FIGS. 6A and 6B for illustrative purposes only. In actuality, the combined thickness of the layers 31 and 32 do not significantly impede the flow of liquid in the direction 29. If desired, the surface 24 of the heat transfer member 14 can be provided with a groove 27, as illustrated in FIG. 6B, so that the thin layer 31 of insulating material can be provided on the bottom wall of the groove 27 with the thin layer 32 of electrically conductive material being provided on top of the insulating layer 31 so that the combined thickness of the two layers 31 and 32 will be beneath or at least flush with the surface 24.

Figure 7A:
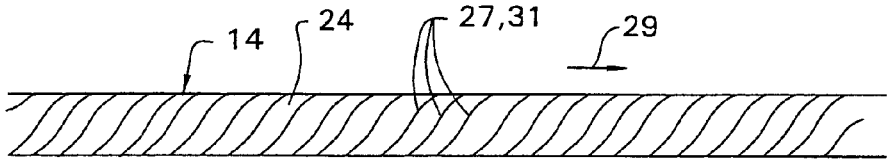
FIGS. 7A through 7D illustrate alternate electrode mounting configurations for the electrodes on the heat transfer members.

FIGS. 7A–7D illustrate various patterns for the surface alteration 27 or 31 made to the exterior surface 24 of the heat transfer member 14. It is to be recognized that the surface alterations can also be applied to the interior surface (not illustrated in FIGS. 7A–7D). Furthermore, the surface alterations 27/31 can be provided on selected regions of a heat transfer member 14 or on only a selected one of the heat transfer members 14 in a tube bundle, such as is illustrated in FIG. 1. In other words, the surface alterations 27/31 can be provided where needed, such as in the bottom part of a condenser or the top part of a falling film evaporator where there generally exists more liquid or in the mid-length region only of a heat transfer member 14 in order to provide flow management characteristics in desired regions and/or to provide a desired redistribution of liquid in order to enhance overall performance of the thermal energy transfer system. FIG. 7A illustrates a surface alteration configuration that will result in the movement of liquid in a single direction 29.

Figure 7B:
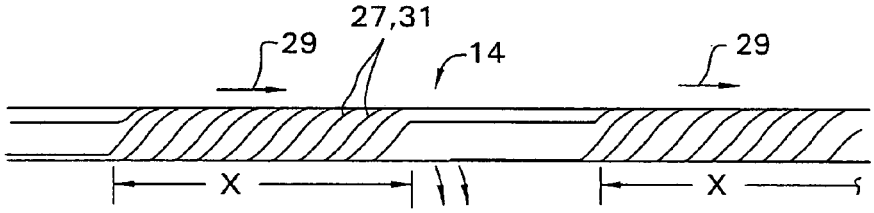

FIG. 7B illustrates spaced arrangements of surface alterations 27, 31 on the surface 24 to cause liquid to traverse longitudinally of the heat transfer member 14 only within the length of the heat transfer member 14 where such surface alterations extend spirally of the heat transfer member, namely, in regions indicated by the character X. In the region where the surface alterations extend parallel to the longitudinal axis of the heat transfer member 14, the liquid will generally drip from the heat transfer member in these regions because the electric wave causing the pumping of the fluid travels in a direction perpendicular to the longitudinal axis of the electrical conductor. Since the electrical conductor is mounted on the surface alterations 27, 31, and since the electrical conductors in-between the regions marked X extend parallel to the longitudinal axis of the heat transfer member, the liquid will be allowed to drip from the heat transfer member at these locations.

Figure 7C:
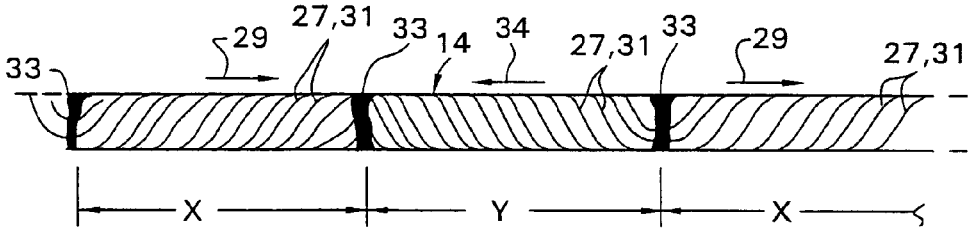

In FIG. 7C, the surface alterations 27, 31 over the regions marked X cause liquid flow to occur in the direction 29. Since the surface alterations 27, 31 are oriented in the region marked Y are oppositely to those in the regions marked X, liquid will flow in the direction 34 opposite to the direction 29.

As illustrated in FIG. 7C, a structure, such as a ring 33 is provided at the junction between two mutually adjacent regions X and Y for effecting securement of the electrical conductors to the transfer member and so that the liquid will be obstructed by the ring 33 and allowed to drip from the heat transfer member 14 at these locations. If there is no such structure (not shown in the drawings) or if the structure is thin, liquid will still drip thereat due to two liquids being pumped in opposite directions.

Figure 7D:
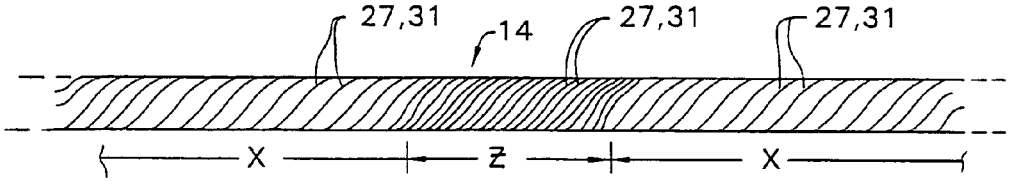

FIG. 7D shows a region Z where the spacing between the electrodes is smaller than the spacing between the regions marked X so that the liquid flowing in the region marked Y will have a controlled or purposefully managed performance characteristic.

Figure 8A:
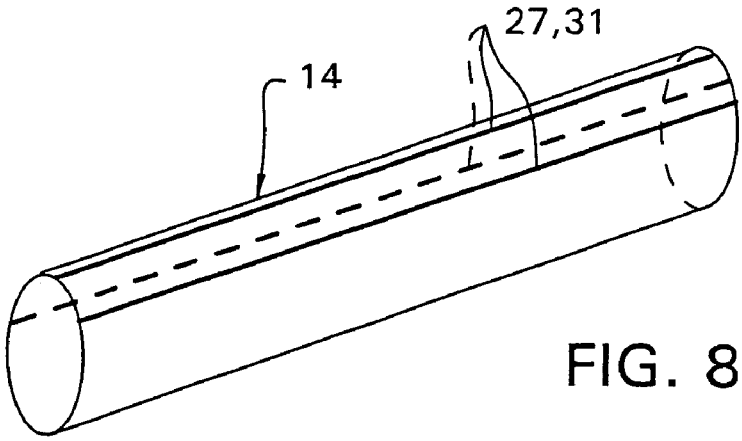
FIGS. 8A through 8C illustrate a still further electrode mounting configuration for the electrodes on a heat transfer member.
Figure 8B:
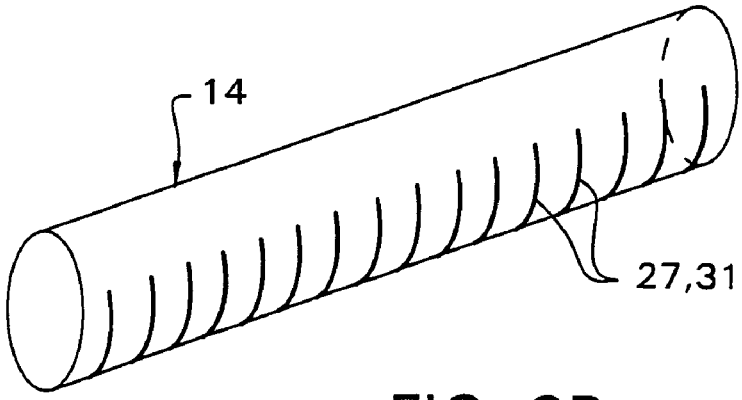
Figure 8C:
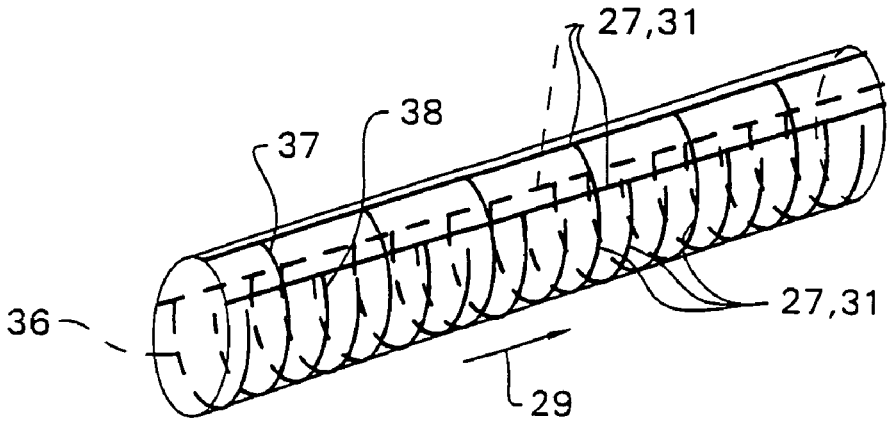

FIGS. 8A through 8C illustrate a further arrangement of surface alterations 27, 31 that can be provided on a surface of the heat transfer member 14. In the embodiment illustrated in FIGS. 8A through 8C, the surface alterations 27, 31 have been provided on the exterior surface 24 of the heat transfer member 14. As illustrated in FIG. 8A, and assuming that the power supply 26 delivers three phase voltage to the electrodes, a plurality of surface alterations 27/31 are provided along the top surface area of the heat transfer member 14 and in a direction that is parallel to the longitudinal axis of the heat transfer member 14. It is within the scope of this invention to provide surface alterations 27/31 that extend only parallel to the longitudinal axis of the heat transfer member 14 as shown in FIG. 8A. Since multiphase power will effect, as described above, an electric traveling wave to move in a direction perpendicular to the longitudinal axis of the electrical conductor 21, 22, 23 oriented on the surface alterations 27/31, liquid forming on the surface 24 of the heat transfer member 14 will be pumped only circumferentially. However, in an additional embodiment, as illustrated in FIG. 8B, and it is desired to manage the liquid flow differently to result in enhanced heat transfer, a plurality of other surface alterations 27, 31 are provided around only a portion of the bottom part of the heat transfer member 14. In this particular embodiment, each surface alteration 27, 31 is oriented in a plane that is perpendicular to the longitudinal axis of the heat transfer member 14. FIG. 8C illustrates additional surface alterations required at 36, 37 and 38 to cause an intersection of the respective one of the surface alterations with the longitudinally extending surface alterations illustrated in FIG. 8A. Thereafter, the electrical conductors 21, 22 and 23 can be placed onto the selected one of the surface alterations 27, 31 and 36, 37, 38. As illustrated in FIG. 8C, some electrical conductors will intersect other electrical conductors. However, since the electrical conductors include an insulating layer 19 around the electrically conductive part, an intersecting of the electrical conductors will be permitted. In the event that the configuration of FIGS. 6A, 6B is utilized, an additional insulative layer will be required where the electrical conductors intersect one another so as to prevent shorting from occurring at the locations of intersection.

During operation, the embodiment of FIG. 8C functioning as a condenser or an evaporator will cause liquid accumulating on the underside of the heat transfer member 14 to be moved in a direction longitudinally of the heat transfer member 14 as schematically illustrated by the arrow 29, namely, in a direction perpendicular to the plane containing the electrodes. This particular configuration will be particularly suitable in environments where gravity plays a roll in causing the liquid to accumulate on the bottom side of the heat transfer member 14.

Figure 9A:
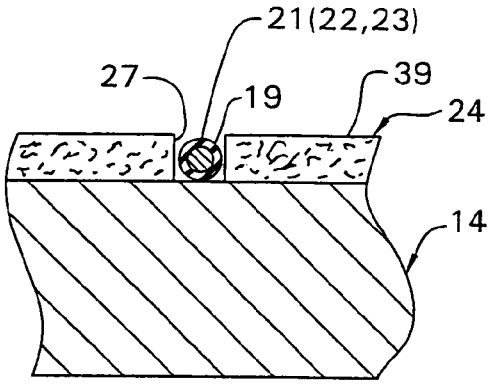
FIGS. 9A through 9C illustrate additional electrode configurations on a heat transfer member that has been additionally provided with heat transfer enhancing surface features.
Figure 9B:
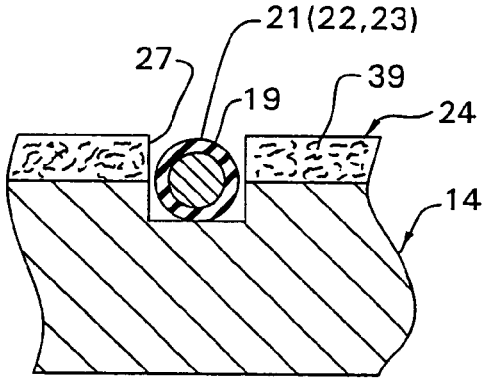
Figure 9C:
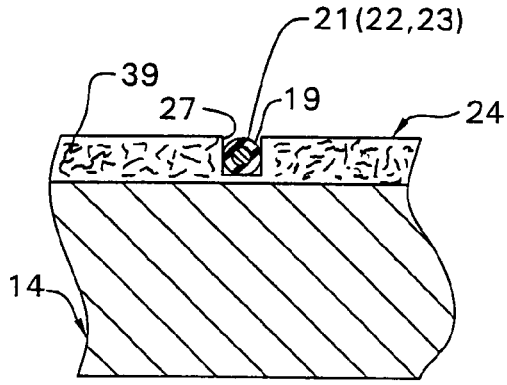

FIGS. 9A through 9C illustrate a heat transfer member 14 wherein the exterior surface has been additionally altered to provide a heat transfer enhancing surface feature 39 of any conventional type. The surface feature 39 can be a surface area increasing structure or a coating on the heat transfer member to alter the surface tension effects thereat. FIG. 9A illustrates that a surface alteration in the form of a groove 27 can be provided in the heat transfer enhancing surface feature 39 to a depth corresponding to the depth surface feature 39. FIG. 9B illustrates that the depth of the groove 27 can exceed the thickness of the surface feature 39. FIG. 9C illustrates that the depth of the groove 27 is less than the thickness of the surface feature 39.

Figure 10:
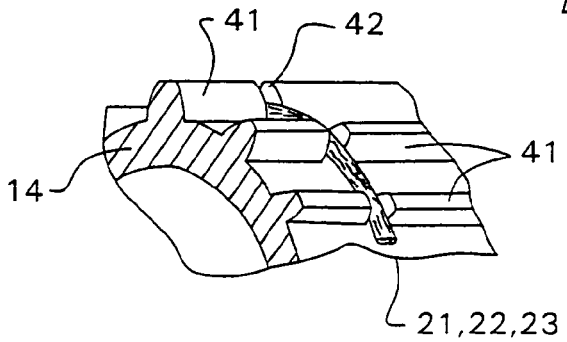
FIG. 10 is a still further electrode configuration on a heat transfer member that has been provided with heat transfer enhancing surface features different from those illustrated in FIGS. 9A through 9C.

FIG. 10 illustrates a heat transfer member 14 having another form of surface enhancement on the exterior surface thereof, namely, upstanding ribs 41 extending in a direction generally parallel to the longitudinal axis of the heat transfer member 14. The upstanding ribs 41 can be oriented as desired, but preferably on the upper part of the heat transfer member so that fluid dropping from heat transfer members oriented thereabove will drop into the region between the ribs 41 and be moved lengthwise of the heat transfer member 14 caused by the traveling electric wave created when multiphase voltage is applied to the electrodes 21, 22 and 23. As illustrated in FIG. 10, slots 42 have been provided in the ribs 41 to facilitate mounting of the conductors 21, 22 and 23 around the perimeter of the heat transfer member 14. If desired, the electrodes 21, 22 and 23 can be provided in additional surface alterations as shown in FIGS. 5A through 5J to accommodate the electrodes 21, 22 and 23 in order to facilitate unobstructed movement of liquid in the longitudinal direction of the heat transfer member 14. The ribs 41 will allow liquid from the heat transfer members oriented thereabove to drop down into the area between the ribs and prevent that liquid from rapidly moving in a circumferential direction to the underside of the conduit to maintain the efficiency of the heat transfer element along the underside of the heat transfer member as well as in accordance with the orientation of the surface alterations shown in FIGS. 8A through 8C.

If desired, additional elongate non-heat transfer members, such as insulating material rods 15 (FIG. 1) can be provided in the outer conduit 13 and which extend generally parallel to the heat transfer conduits or members 14. Electrical conductors are provided on the rods either on the outer surface thereof or on surface alterations on the rods 15 to facilitate liquid management or distribution inside the outer conduit in a purposefully controlled way using the teachings described above.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In a thermal energy transfer system comprising a heat transfer member having separate first and second surfaces each subjected to separate first and second temperatures, at least one of the first and second surfaces also being configured to be subjected to a fluid so that a liquid phase of the fluid is present on the at least one of said first and second surfaces, the improvement wherein:

said first surface comprising multiple and separate first surface alterations extending coextensively with an axial length of said heat transfer member and being spirally wound in plural groups, a first group being spirally wound in a first longitudinal direction along a segment of length of said heat transfer member, a mutually adjacent second group being oriented a longitudinal distance from said first group and being spirally wound in a second direction along a further segment of length of said heat transfer member opposite said first direction; a mutually adjacent third group being oriented a longitudinal distance from said second group and being spirally wound in said first direction along yet a further segment of length of said heat transfer member;

separate multiple electrical conductors each being received on a respective one of said separate first surface alterations;

an electric multi-phase alternating power source having multiple terminals and producing a number of phases corresponding to a number of said multiple terminals, each of said multiple electrical conductors being connected to a different one of said multiple terminals to cause, when energized by said power source, an electric traveling wave moving in a longitudinal direction of said heat transfer member to induce a pumping of the liquid phase in the longitudinal direction to thereby enhance the thermal energy transfer characteristics of said thermal energy transfer system;

whereby each group will produce an electric traveling wave moving in a direction opposite to the direction of an electric traveling wave of a mutually adjacent group so as to induce pumping of said thin liquid layer in each group at least one of away from each other and toward each other.

2. The thermal energy transfer system according to claim 1, wherein each said first surface alteration is a recess in the heat transfer member, each said separate electrical conductor being received in a respective one of said recesses.

3. The thermal energy transfer system according to claim 2, wherein said electrical conductors each have an outer surface oriented at least one of flush with and entirely beneath said first surface so that liquid will be able to flow in respective said first and second directions on said first surface unobstructed by said electrical conductors.

4. The thermal energy transfer system according to claim 1, wherein each said first surface alteration is a recess in the heat transfer member, each said separate electrical conductor being received in a respective one of said recesses, wherein each said first surface alteration additionally includes a thin and flat electrically insulative layer fixedly applied to a bottom wall of each respective said recess and wherein each said electrical conductor is a thin and flat electrical conductor fixedly applied to each said insulative layer to electrically insulate each said electrical conductor from said heat transfer member.

5. The thermal energy transfer system according to claim 4, wherein said electrical conductors each have an outer surface oriented at least one of flush with and entirely beneath said first surface so that liquid will be able to flow in respective said first and second direction on said first surface unobstructed by said electrical conductors.

6. In a thermal energy transfer system comprising plural heat transfer members each having separate first and second surfaces each subjected to separate first and second temperatures, at least one of the first and second surfaces also being configured to be subjected to a fluid so that a liquid phase of the fluid is present on the at least one of said first and second surfaces, and an outer conduit in which is oriented the plural heat transfer members, the improvement wherein:

said first surface comprising multiple and separate first surface alterations extending coextensively with an axial length of said heat transfer member and being spirally wound in plural groups, a first group being spirally wound in a first longitudinal direction along a segment of length of said heat transfer member, a mutually adjacent second group being oriented a longitudinal distance from said first group and being spirally wound in a second direction along a further segment of length of said heat transfer member opposite said first direction; a mutually adjacent third group being oriented a longitudinal distance from said second group and being spirally wound in said first direction along yet a further segment of length of said heat transfer member;

separate multiple electrical conductors each being received on a respective one of said separate first surface alterations;

an electric multi-phase alternating power source having multiple terminals and producing a number of phases corresponding to a number of said multiple terminals, each of said multiple electrical conductors being connected to a different one of said multiple terminals to cause, when energized by said power source, an electric traveling wave moving in a longitudinal direction of said heat transfer member to induce a pumping of the liquid phase in the longitudinal direction to thereby enhance the thermal energy transfer characteristics of said thermal energy transfer system;

whereby each group will produce an electric traveling wave moving in a direction opposite to the direction of an electric traveling wave of a mutually adjacent group so as to induce pumping of said thin liquid layer in each group at least one of away from each other and toward each other.

7. The thermal energy transfer system according to claim 6, wherein each said first surface alteration is a recess in the heat transfer member, each said separate electrical conductor being received in a respective one of said recesses.

8. The thermal energy transfer system according to claim 7, wherein said electrical conductors each have an outer surface oriented at least one of flush with and entirely beneath said first surface so that liquid will be able to flow in respective said first and second directions on said first surface unobstructed by said electrical conductors.

9. The thermal energy transfer system according to claim 6, wherein each said first surface alteration is a recess in the heat transfer member, each said separate electrical conductor being received in a respective one of said recesses, wherein each said first surface alteration additionally includes a thin and flat electrically insulative layer fixedly applied to a bottom wall of each respective said recess and wherein each said electrical conductor is a thin and flat electrical conductor fixedly applied to each said insulative layer to electrically insulate each said electrical conductor from said heat transfer member.

10. The thermal energy transfer system according to claim 9, wherein said electrical conductors each have an outer surface oriented at least one of flush with and entirely beneath said first surface so that liquid will be able to flow in respective said first and second directions on said first surface unobstructed by said electrical conductors.

* * * * *